US006840657B2

(12) United States Patent
Tung

(10) Patent No.: US 6,840,657 B2
(45) Date of Patent: Jan. 11, 2005

(54) SUNSHADE WITH AN ILLUMINATING DEVICE

(76) Inventor: Benson Tung, No. 587, Chien-Gong Road, San Ming, Kaohsiung (TW)

( * ) Notice: Subject to any disclaimer, the term of this patent is extended or adjusted under 35 U.S.C. 154(b) by 60 days.

(21) Appl. No.: 10/376,066

(22) Filed: Feb. 26, 2003

(65) Prior Publication Data

US 2004/0165392 A1 Aug. 26, 2004

(51) Int. Cl.[7] ..... F21V 1/06; F21V 11/00

(52) U.S. Cl. ..... 362/352; 362/102; 362/127; 362/183; 362/184; 362/234; 362/251; 135/910

(58) Field of Search ..... 362/352, 102, 362/127, 183, 184, 234, 249, 251; 135/910, 66, 911

(56) References Cited

U.S. PATENT DOCUMENTS 2,087,537 A * 7/1937 Finkel ..... 362/102
6,017,188 A * 1/2000 Benton ..... 416/5
6,439,249 B1 * 8/2002 Pan et al. ..... 135/16

* cited by examiner

*Primary Examiner*—Stephen Husar
*Assistant Examiner*—Sharon Payne
(74) *Attorney, Agent, or Firm*—Alan Kamrath; Nikolai & Mersereau PA

(57) ABSTRACT

A sunshade includes a post having a rib-mounting member mounted thereon, a plurality of ribs each having an upper end pivotally connected to the rib-mounting member, a runner slidably mounted on the post, a plurality of stretchers each having an upper end pivotally connected to an intermediate portion of an associated rib and a lower end pivotally connected to the runner, a solar energy device mounted on the sunshade for receiving solar energy and transforming solar energy into electricity, and at least one light unit mounted on at least one of the ribs. The light unit is electrically connected to the solar energy device, thereby providing illumination without the need of an external power source.

20 Claims, 15 Drawing Sheets

SUNSHADE WITH AN ILLUMINATING DEVICE

BACKGROUND OF THE INVENTION

1. Field of the Invention

The present invention relates to a sunshade with an illuminating device for providing outdoor illumination.

2. Description of the Related Art

A sunshade shields people from sunlight and is thus widely used in outdoor cafes and rest areas as well as on beaches. An illuminating device is attached to a sunshade for illumination purposes, and an external power source is required. Typically, one or more bulbs are attached to the sunshade and connected to an indoor socket or a generator. However, use of the generator is troublesome. Further, the external power source is not available everywhere. The present invention is intended to provide a sunshade with an illuminating device to meet this end.

SUMMARY OF THE INVENTION

An object of the present invention is to provide a sunshade with an illuminating device that has a solar energy receiver for receiving solar energy and providing electricity to the bulbs attached to the sunshade.

A sunshade in accordance with the present invention includes a post having a rib-mounting member mounted thereon, a plurality of ribs each having an upper end pivotally connected to the rib-mounting member, a runner slidably mounted on the post, a plurality of stretchers each having an upper end pivotally connected to an intermediate portion of an associated rib and a lower end pivotally connected to the runner, a solar energy device mounted on the sunshade for receiving solar energy and transforming solar energy into electricity, and at least one light unit mounted on at least one of the ribs. The light unit is electrically connected to the solar energy device, thereby providing illumination without the need of an external power source.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
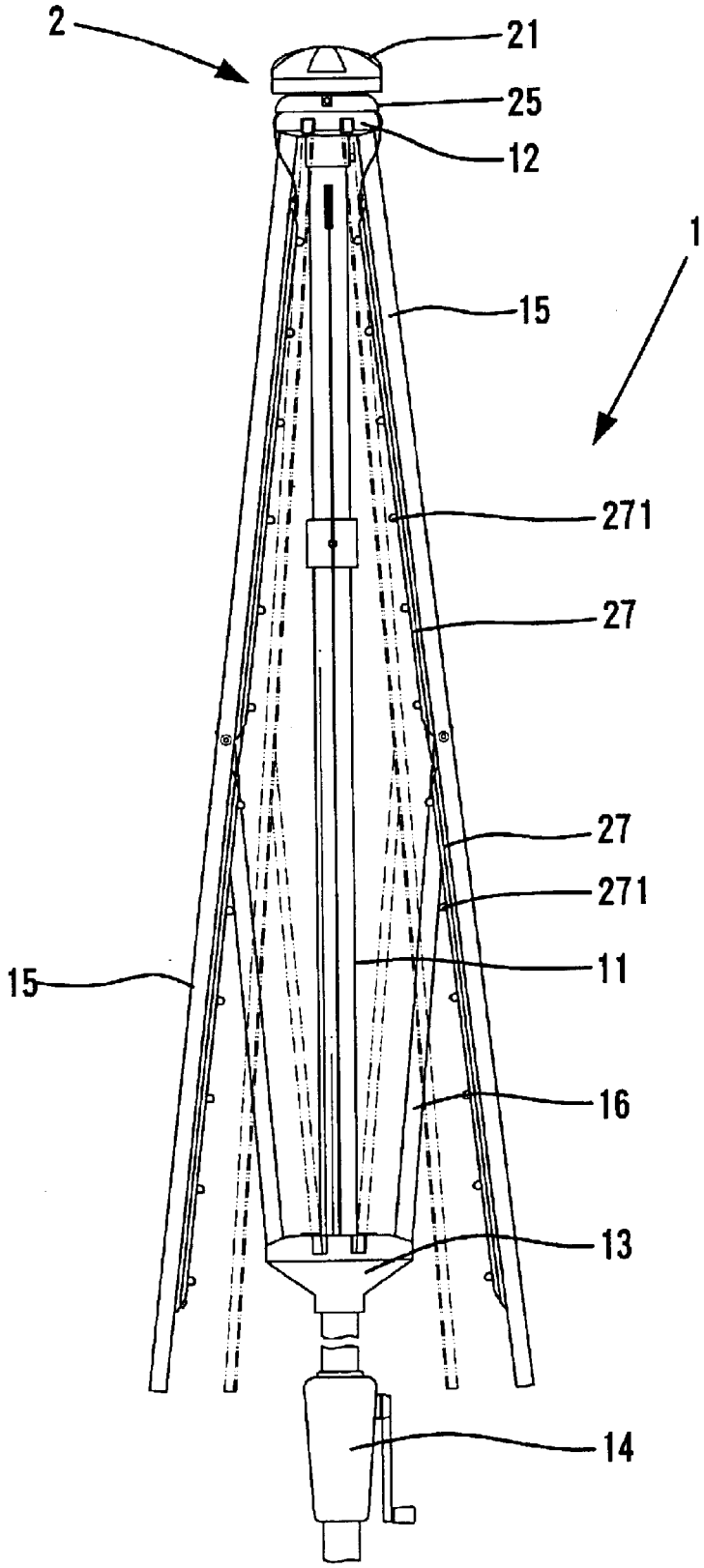
FIG. 1 is a side view of a sunshade equipped with a first embodiment of an illuminating device in accordance with the present invention.

Referring to FIG. 1, an illuminating device 2 in accordance with the present invention is attached to a sunshade 1 that generally comprises a post 11, a rib-mounting member 12 on top of the post 11, a plurality of ribs 15 each having an end pivotally connected to the rib-mounting member 12, a runner 13 slidably mounted to the post 11, a plurality of stretchers 16 each having a first end pivotally connected to the runner 13 and a second end pivotally connected to an intermediate portion of an associated one of the ribs 15. A reel 14 is provided to the post 11 for unfolding and folding the sunshade 1. A tubular member 121 is provided on top of the rib-mounting member 12 as shown in FIG. 2.

Figure 2:
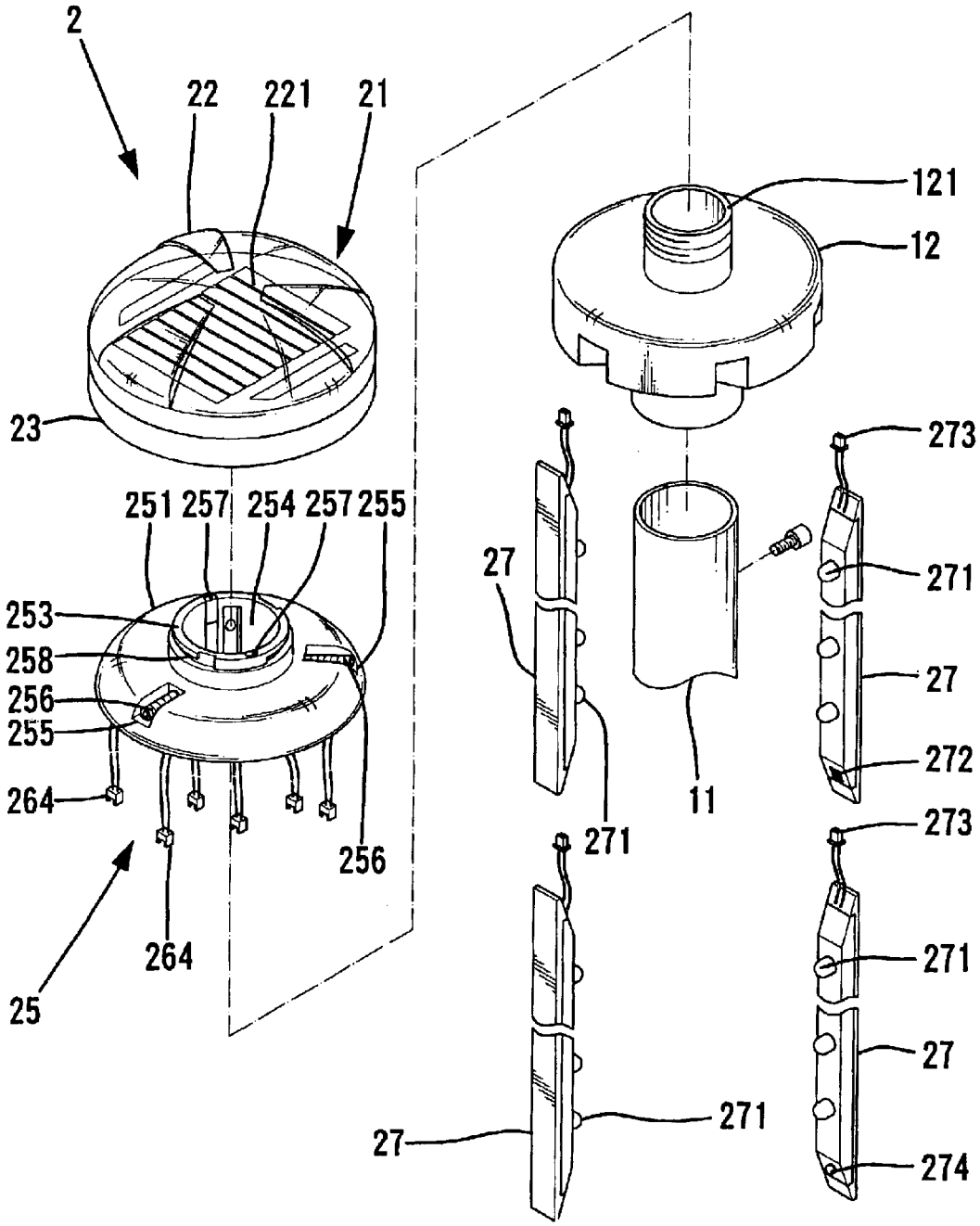
FIG. 2 is an exploded perspective view of the illuminating device in FIG. 1.

Still referring to FIG. 1 and further to FIG. 2, the illuminating device 2 in accordance with the present invention includes at least one light unit 27 mounted on one or more of the ribs 15 and a solar energy device that includes a mounting member 25 and a solar energy receiver 21 mounted on top of the mounting member 25 for providing electricity to the light unit 27. In this embodiment, the sunshade 1 may include a plurality of light units 27 as many as desired, with the light units 27 on each rib 15 or all ribs 15 being electrically connected with one another.

Figure 3:
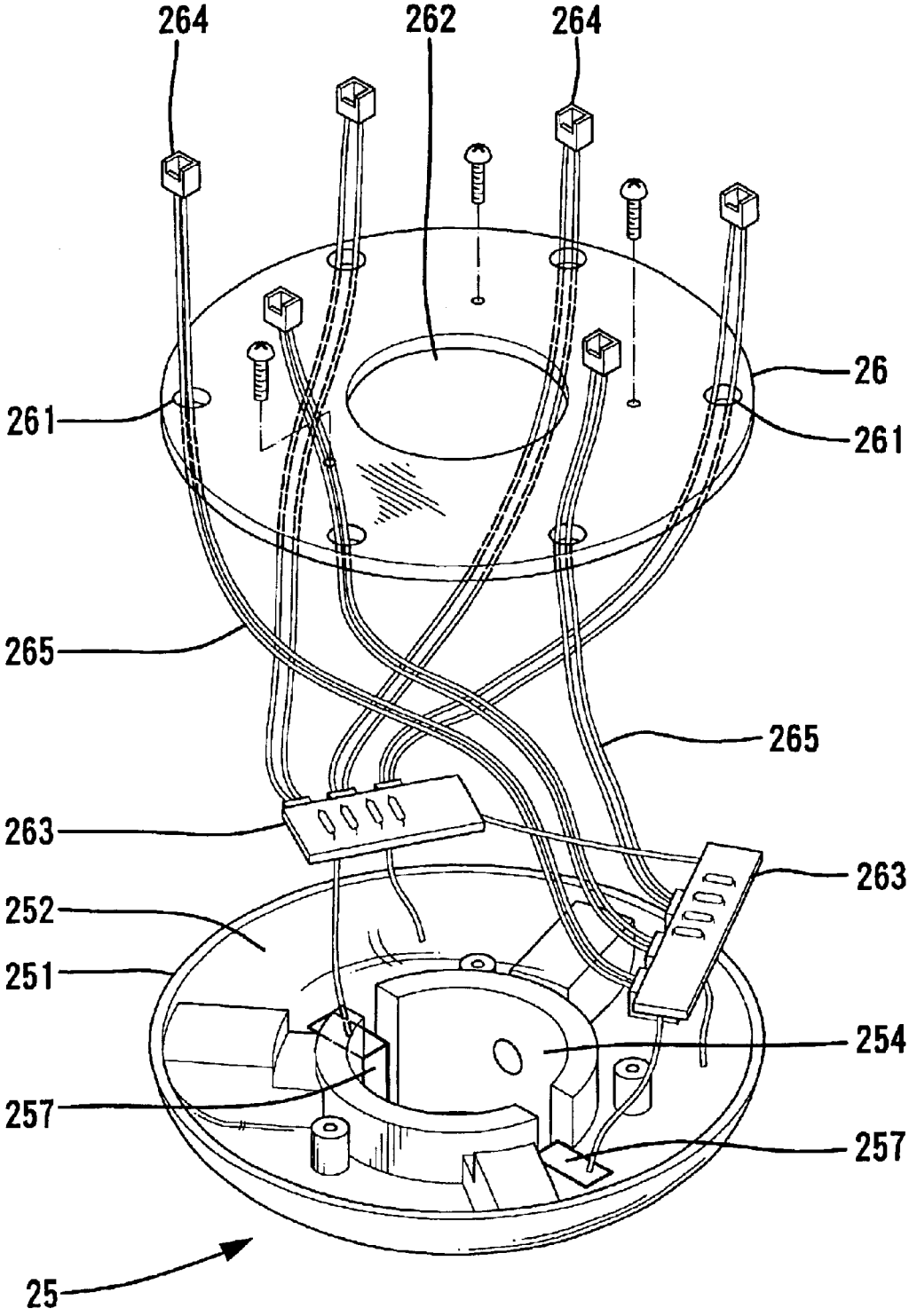
FIG. 3 is an exploded perspective view, in an upside-down state, of a mounting member of the illuminating device.

Referring to FIGS. 2 and 3, the mounting member 25 includes a base 251 and a cover or lid 26 attached to an underside of the base 251. The base 251 includes a compartment 252 that opens downward (downward in FIG. 3). The base 251 further includes an engaging portion 253 having an engaging hole 254. Two diametrically opposed engaging grooves 258 are defined in an outer periphery of the engaging portion 253, and two diametrically opposed conductive plates 257 are mounted to an inner periphery of the engaging portion 253. The base 251 further has a plurality of recesses 255 on an outer periphery thereof that are located outside the engaging portion 253. A screw 256 is extended through a respective recess 255 into the engaging hole 254. Mounted in the compartment 252 of the base 251 are a plurality of circuit boards 263 that are electrically connected to the conductive plates 257. The lid 26 includes a central hole 262 aligned with the engaging hole 254 of the base 251 and a plurality of holes 261 around the central hole 262. A plurality of female connectors 264 are mounted outside the mounting member 25, with each female connector 264 being electrically connected to a respective circuit board 263 by wires 265 that extend through a respective hole 261.

Figure 4:
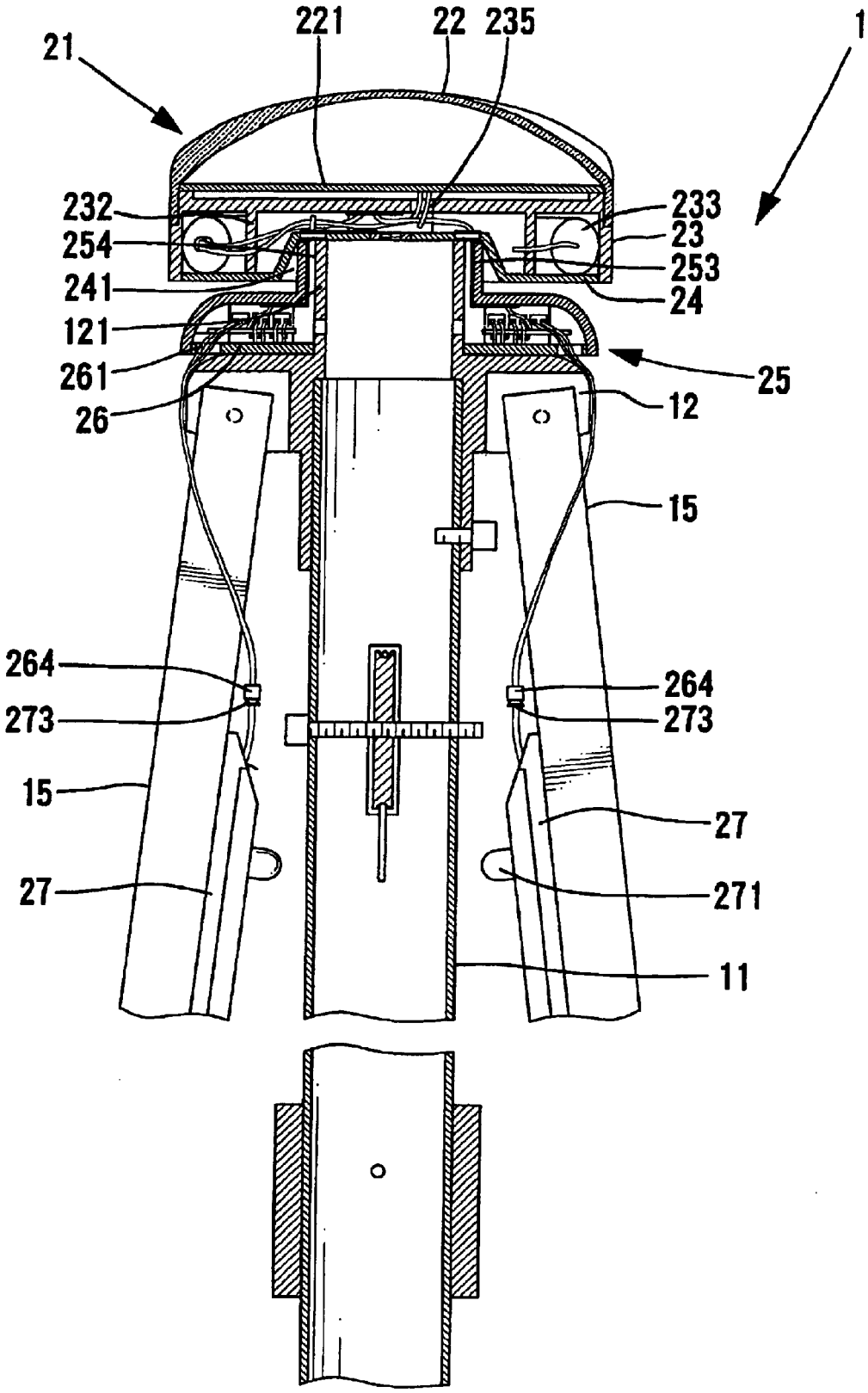
FIG. 4 is a sectional view of an upper portion of the sunshade in FIG. 1.

Referring to FIGS. 2 and 4, the engaging hole 254 of the base 25 is engaged with the tubular member 121 of the rib-mounting member 12 of the sunshade 1, with the respective screw 256 being turned inward to a position to frictionally retain the base 25 on the rib-mounting member 12. The respective wires 265 for the respective female connector 264 are extended through a respective hole 261 of the lid 26 to a position outside the mounting member 25.

Referring to FIGS. 1, 2, and 4, each light unit 27 includes one or more bulbs 271, a female connector 272 on an end thereof, and a male connector 273 on the other end thereof. The male connector 273 of the uppermost light unit 27 on each rib 15 is electrically connected to a respective female connector 264 of the mounting member 25. The male connector 273 of a lower light unit 27 is electrically connected to the female connector 272 of an upper light unit 27. Thus, the light units 27 on the respective rib 15 are connected in series. Of course, all of the light units 27 can be connected in series while using only one female connector 264.

Figure 5:
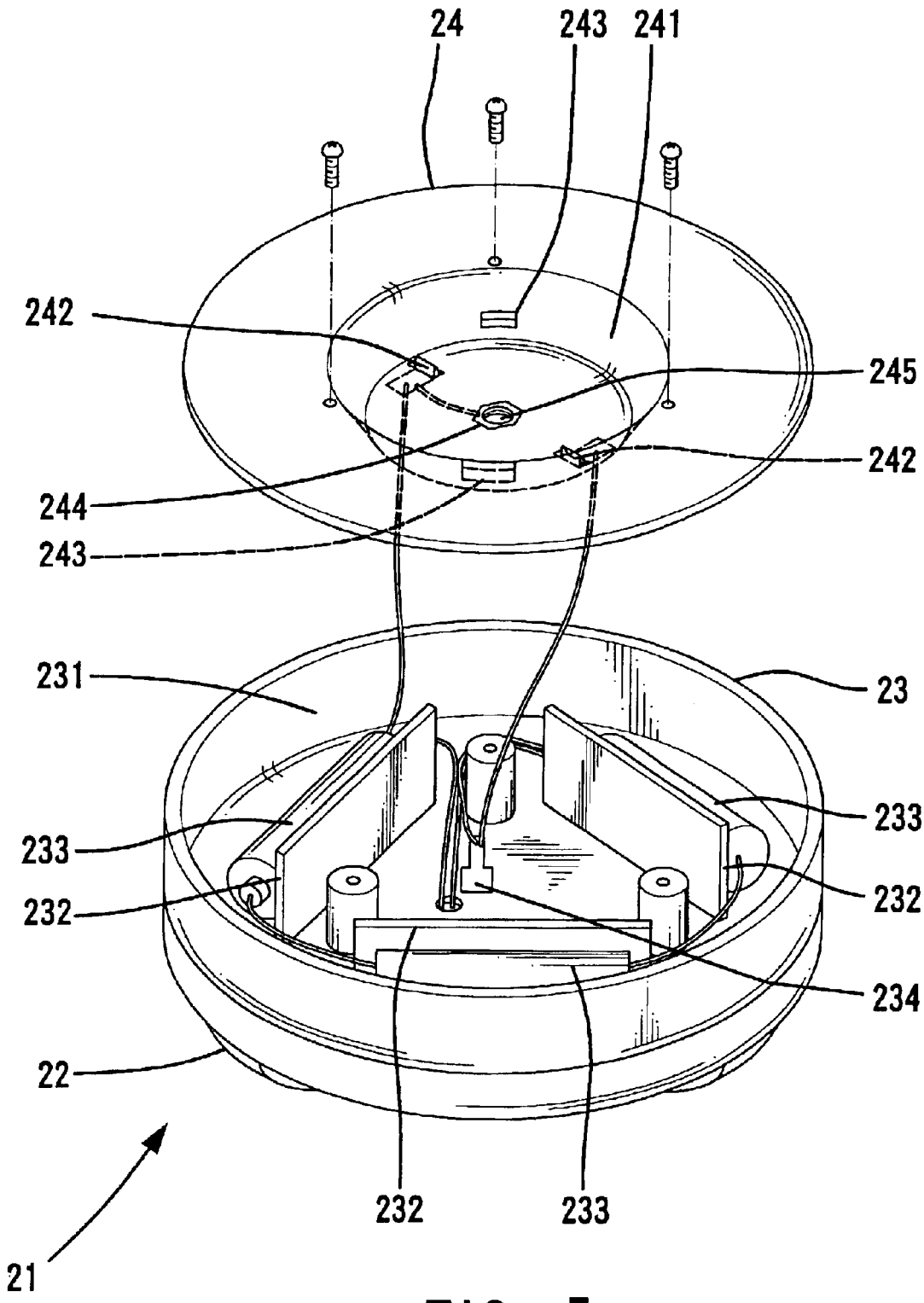
FIG. 5 is an exploded perspective view, in an upside-down state, of a solar energy receiver of the illuminating device.

Referring to FIGS. 2, and 5, the solar energy receiver 21 includes a base 23, a light-transmittable upper cover 22, and a lower cover 24. A photoelectric plate 221 is mounted between the upper cover 22 and the base 23. Defined by the base 23 and the lower cover 24 is a compartment 231 in which a plurality of partitioning plates 232 are mounted. The spaces (not labeled) formed by the partitioning plates 232 receive solar batteries 233 that are electrically connected by wires passing through hole 235 in base 23 to the photoelectric plate 221. Thus, the solar batteries 233 store energy that is obtained at the photoelectric plate 221 that transforms solar energy into electricity. Also mounted in the compartment 231 is a conductive plate 234 that is electrically connected to the solar batteries 233. A downwardly facing recess 241 is defined in an underside of the lower cover 24, with two engaging members 243 being formed on a peripheral wall delimiting the recess 241, with two contacts 242 being provided on a top wall delimiting the recess 241, and with a conductive member 244 having a screw hole 245 being provided on the top wall delimiting the recess 241. The conductive member 244 is electrically connected to one of the contacts 242. One of the contacts 242 is electrically connected to one of the solar batteries 233 and the other to the conductive plate 234.

Figure 6:
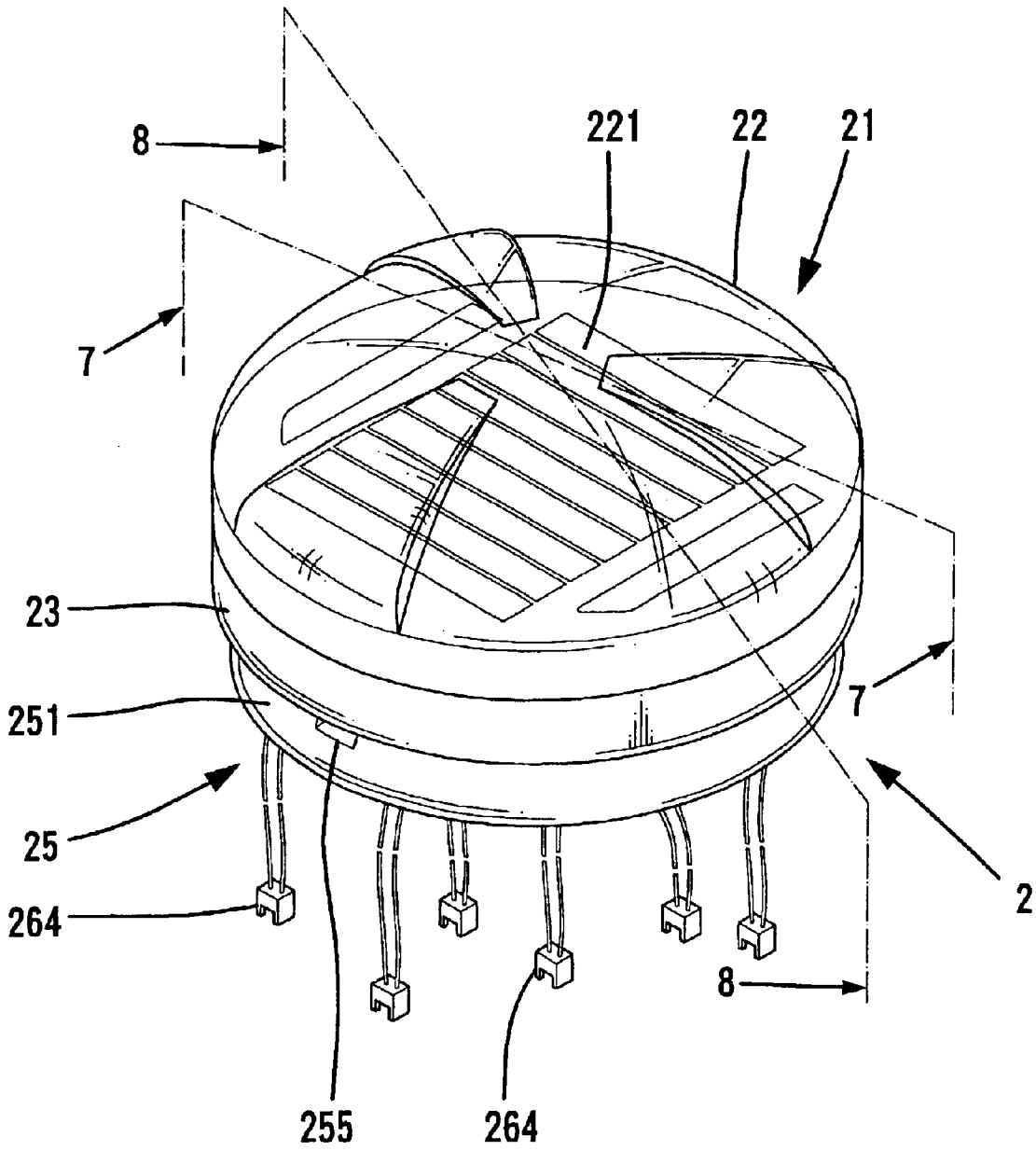
FIG. 6 is a perspective view of the solar energy receiver of the illuminating device.
Figure 7:
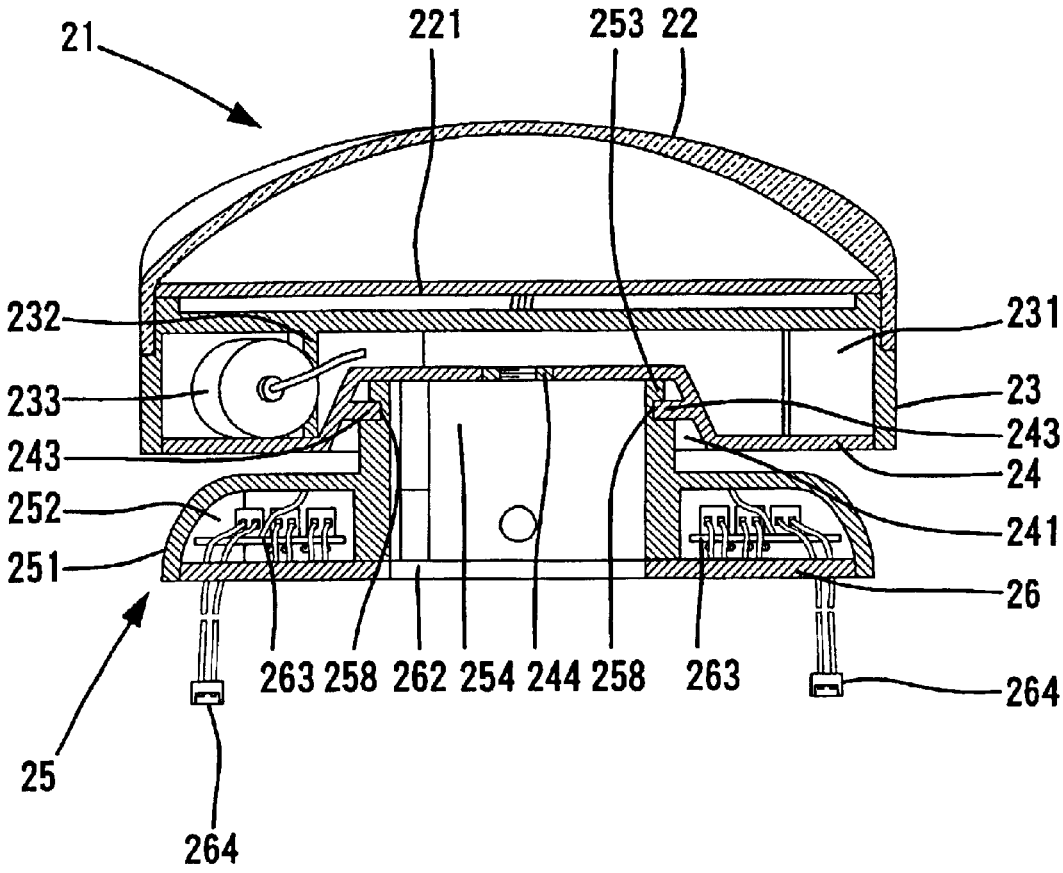
FIG. 7 is a sectional view taken along plane 7—7 in FIG. 6.
Figure 8:
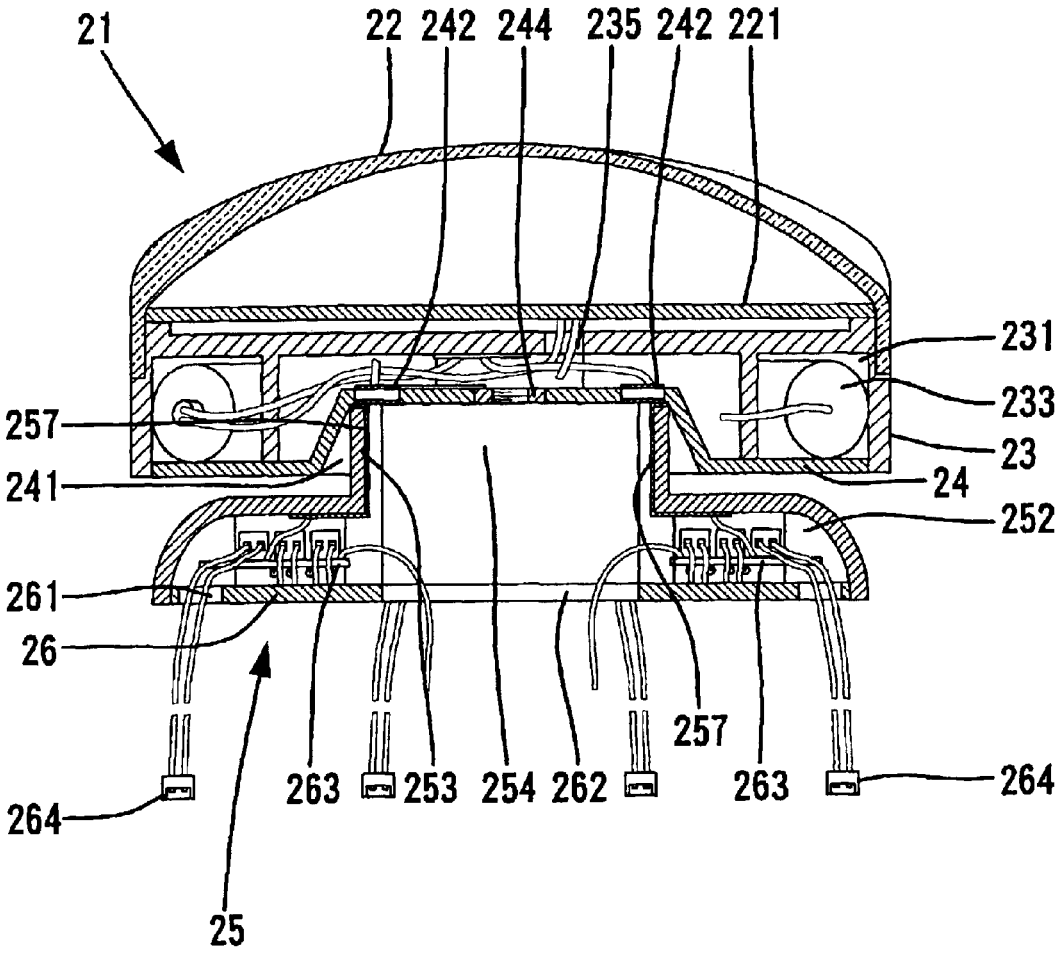
FIG. 8 is a sectional view taken along plane 8—8 in FIG. 6.

As illustrated in FIGS. 6 and 7, the solar energy receiver 21 is mounted to the engaging portion 253 of the mounting member 25, with the engaging members 243 of the solar energy receiver 21 being engaged into the engaging grooves 258 of the engaging portion 253 of the mounting member 25 and then turned through an angle, thereby securely mounting the solar energy receiver 21 on top of the mounting member 25. Referring to FIG. 8, after the solar energy receiver 21 has been rotated through an angle, the contacts 242 on the lower cover 24 of the solar energy receiver 21 are respectively electrically connected with the conductive plates 257 of the mounting member 25. Thus, the electricity of the solar energy receiver 21 can be used to light the bulbs 271 of the light units 27 through the conductive plates 257 of the mounting member 25.

In use, a switch 274 (FIG. 2) may be provided on one of the light units 27 for controlling on/off of the bulbs 271. A portion of the light beams emitted from the bulbs 271 is incident on the solar energy receiver 21 and is thus again transformed into electricity which is then stored in the solar batteries 233.

Figure 9:
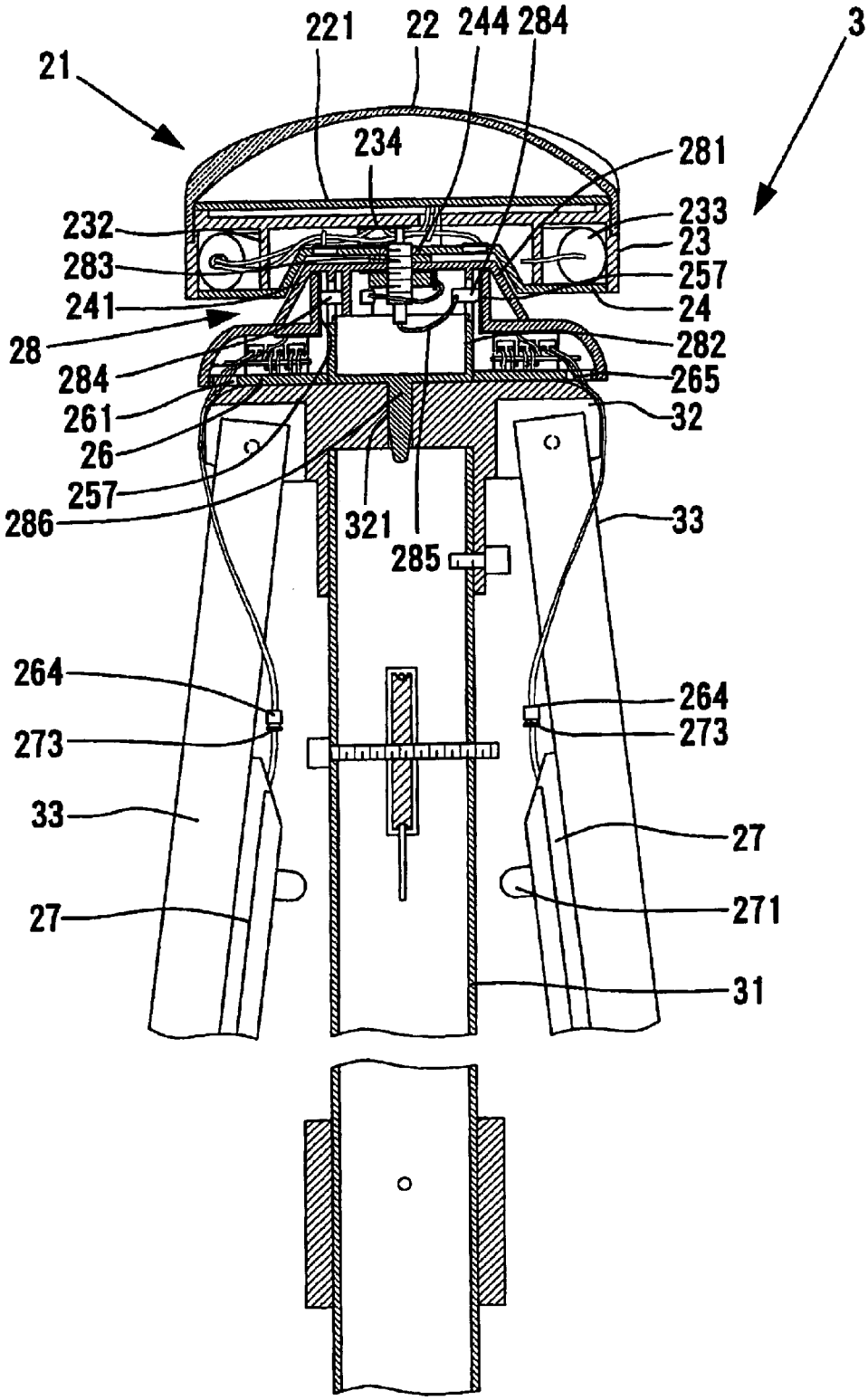
FIG. 9 is a sectional view of an upper portion of a sunshade equipped with a second embodiment of the sunshade in accordance with the present invention.
Figure 10:
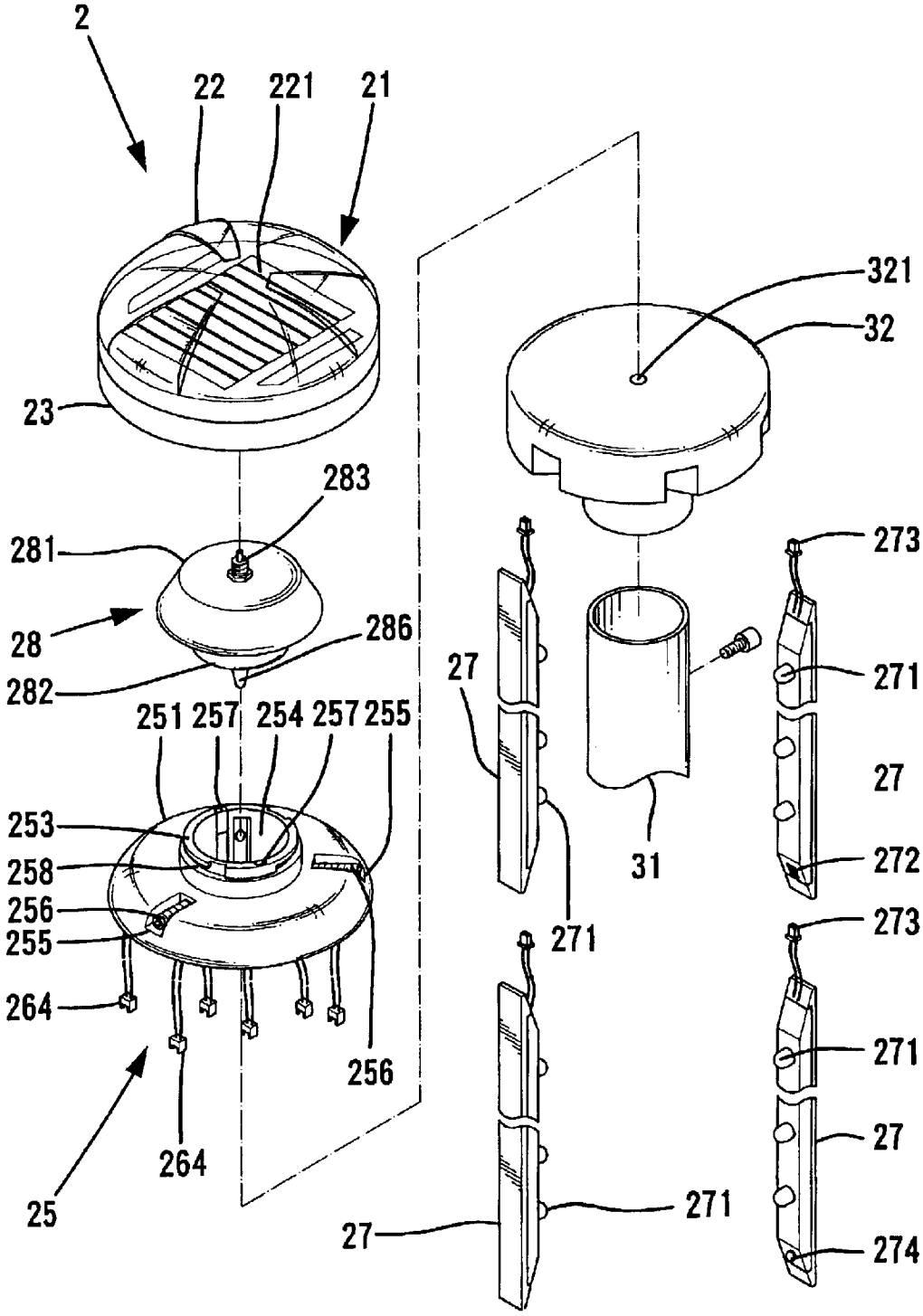
FIG. 10 is an exploded perspective view of the illuminating device in FIG. 9.

FIGS. 9 and 10 show a second embodiment of the invention. In this embodiment, the illuminating device 2 is mounted to a wooden sunshade 3 that has a structure substantially the same as that shown in FIGS. 1 through 8. Specifically the, sunshade 3 includes a post 31, a rib-mounting member 32 on top of the post 31 and a plurality of ribs 33 each having an end pivotally connected to the rib-mounting member 32. What is characteristically different from the sunshade of FIGS. 1 through 8 is that the rib-mounting member (now designated by 32) of the sunshade 3 includes a through-hole 321, and the illuminating device 2 includes a corresponding connecting member 28 so as to be mounted on the rib-mounting member 32. The connecting member 28 includes an upper cover 281 and a base 282 mounted below the upper cover 281. A conductive post 283 is provided on top of the upper cover 281, and two conductive plates 284 are provided on the base 282, with the conductive plates 284 being electrically connected via wires 285 to the conductive column 283. An engaging member 286 extends downward from the base 282 that is located in the engaging hole 254 of the mounting member 25, with the conductive plates 284 of the connecting member 28 being electrically connected to the conductive plates 257 of the mounting member 25, with the conductive column 283 of the connecting member 28 being threadedly engaged in the screw hole 245 of the conductive member 244, and with an upper end of the conductive column 283 pressing against the conductive plate 234 of the solar energy receiver 21. Thus, the solar energy receiver 21 is connected to the mounting member 25. Further, the engaging member 286 of the connecting member 28 is extended into the through-hole 321 of the rib-mounting member 32. Thus, the solar energy receiver 21, the connecting member 28, and the mounting member 25 are securely mounted on the rib-mounting member 32 of the sunshade 3. Again, female connectors 264 outside the mounting member 25 are electrically connected to the light units 27 on the ribs (now designated by 33) of the sunshade 3, and the switch 274 on one of the light units 27 controls on/off of the bulbs 271 of the light units 27.

Figure 11:
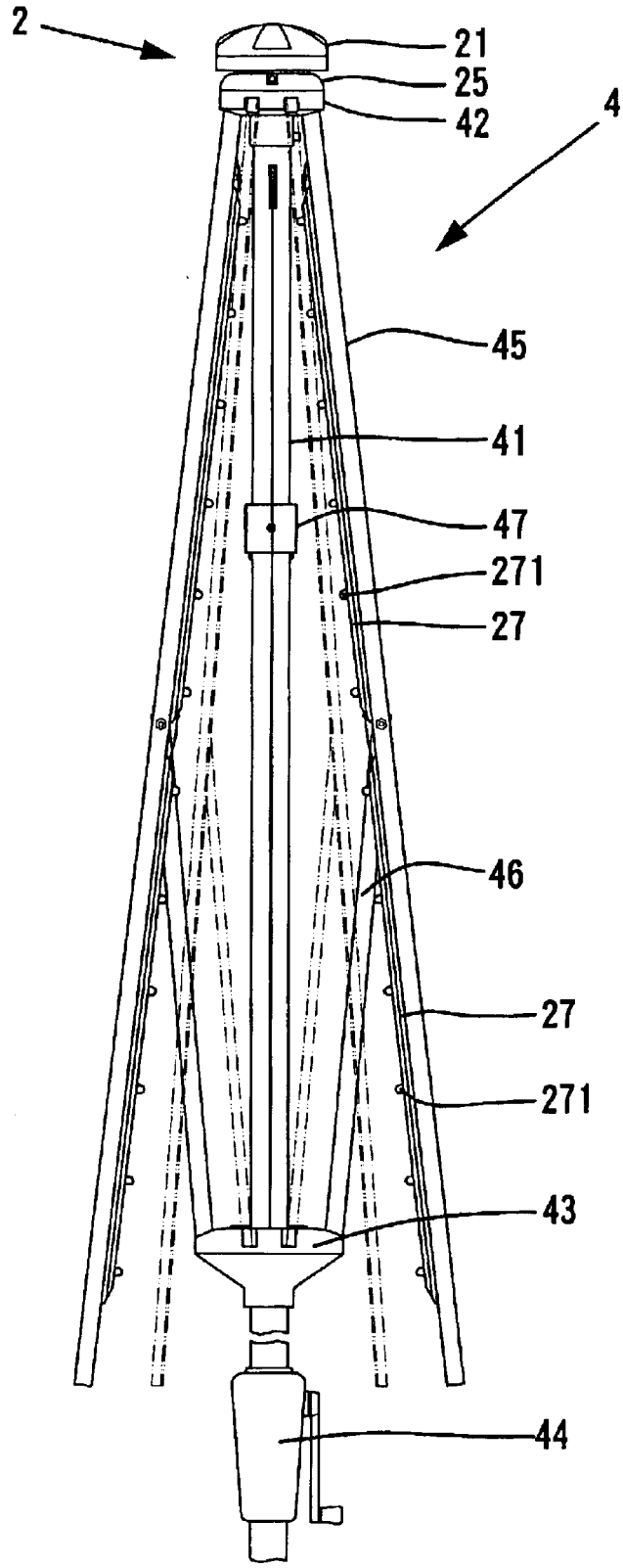
FIG. 11 is a side view of a sunshade equipped with a third embodiment of the illuminating device in accordance with the present invention.

FIG. 11 shows a third embodiment of the invention. The sunshade 4 comprises a post 41, a rib-mounting member 42 on top of the post 41, a plurality of ribs 45 each having an end pivotally connected to the rib-mounting member 42, a runner 43 slidably mounted to the post 41, a plurality of stretchers 46 each having a first end pivotally connected to the runner 43 and a second end pivotally connected to an intermediate portion of an associated one of the ribs 45. A reel 44 is provided to the post 41 for unfolding and folding the sunshade 4. A tubular member 421 is provided on top of the rib-mounting member 42. Further, the rib-mounting member 42 has a plurality of through-holes 422. Each rib 45 has a transverse hole 451 in an upper end thereof. A positioning sleeve 47 is fixed to the post 41 of the sunshade 4 and located above the runner 43. Two conductive pins 471 are provided in the positioning sleeve 47, and the runner 43 includes two conductive pegs 431 that are extended into the runner 43 and electrically connected with each other by a wire 432.

Figure 12:
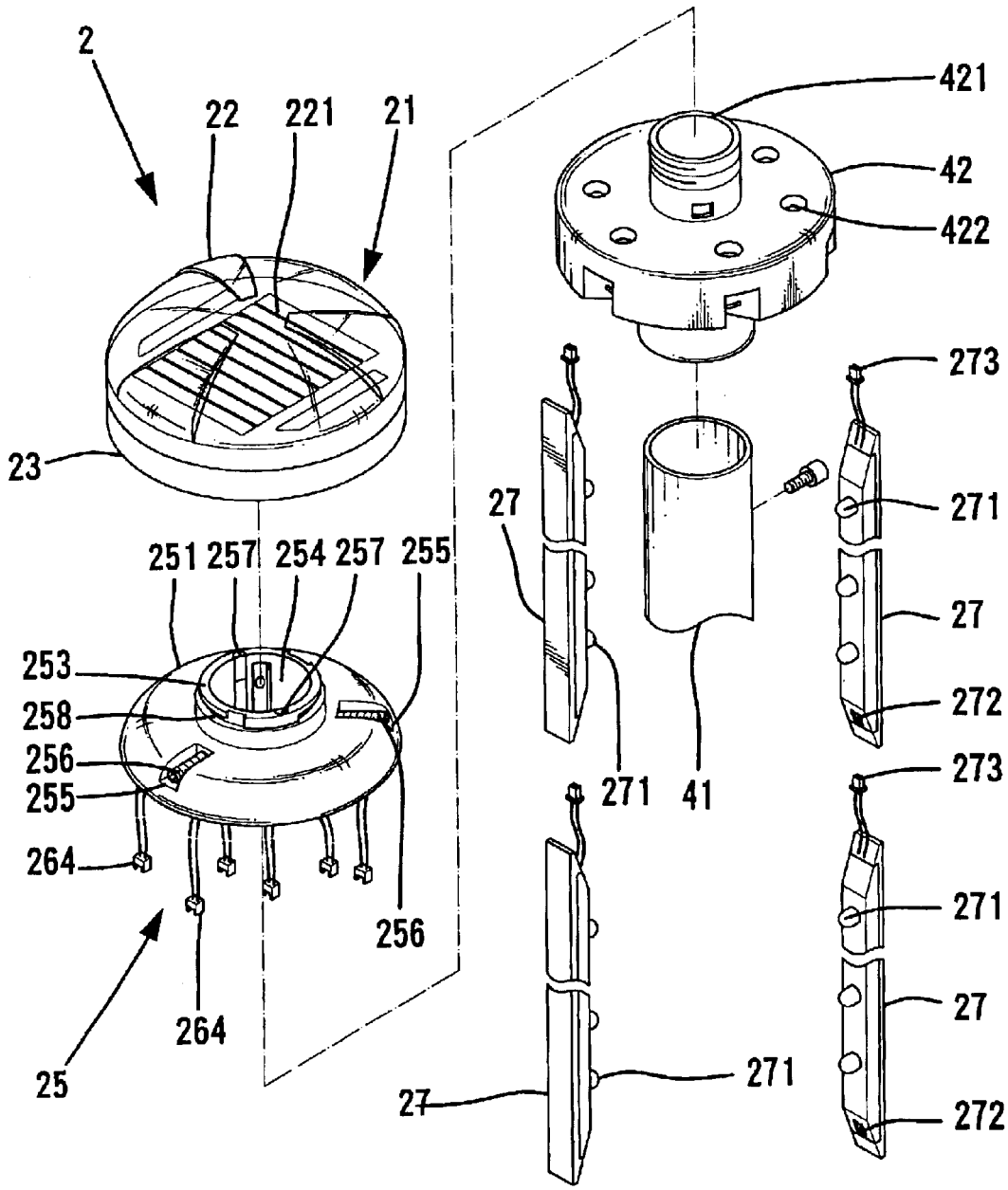
FIG. 12 is an exploded perspective view of the illuminating device in FIG. 11.
Figure 13:
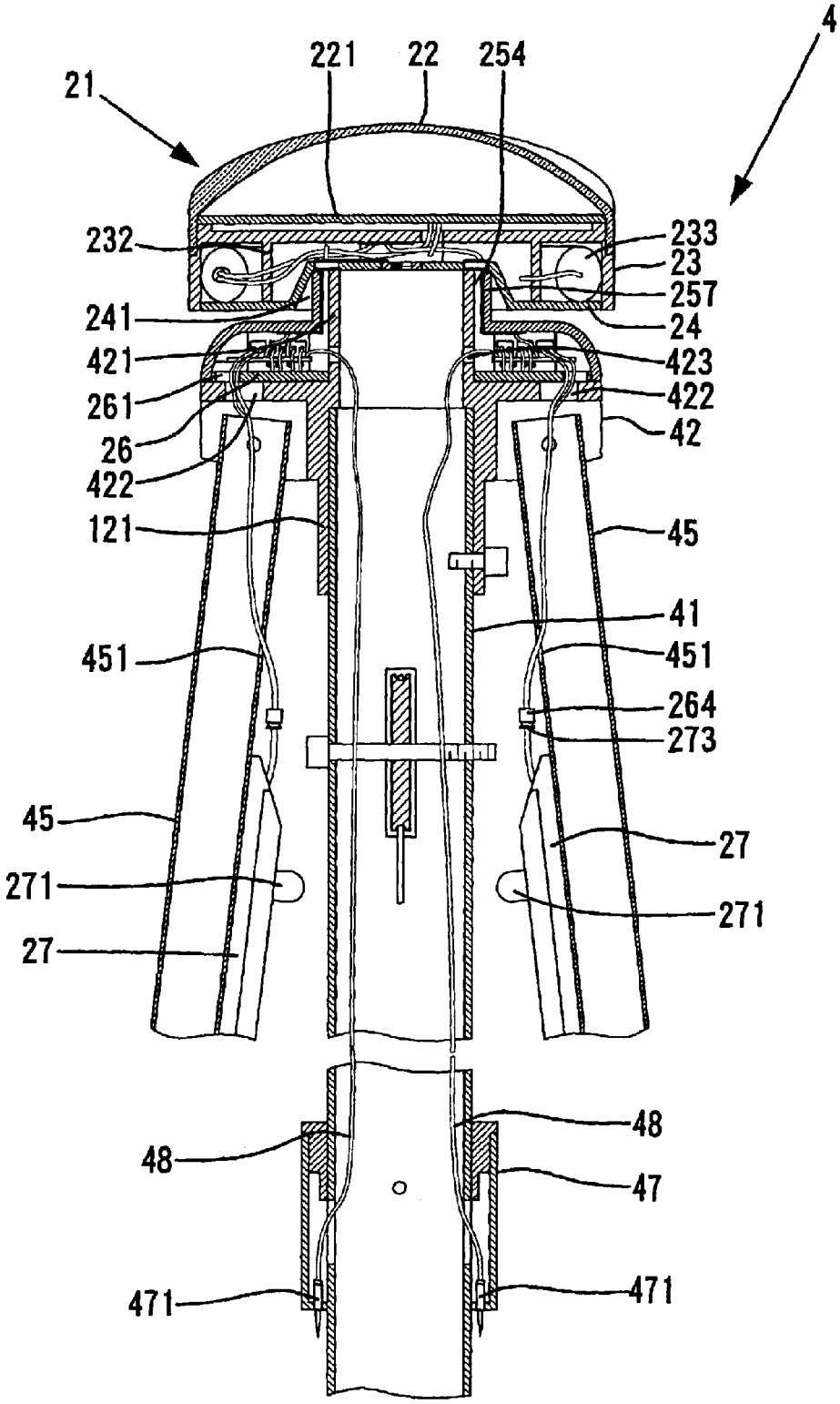
FIG. 13 is a sectional view of an upper portion of the sunshade in FIG. 11.
Figure 14:
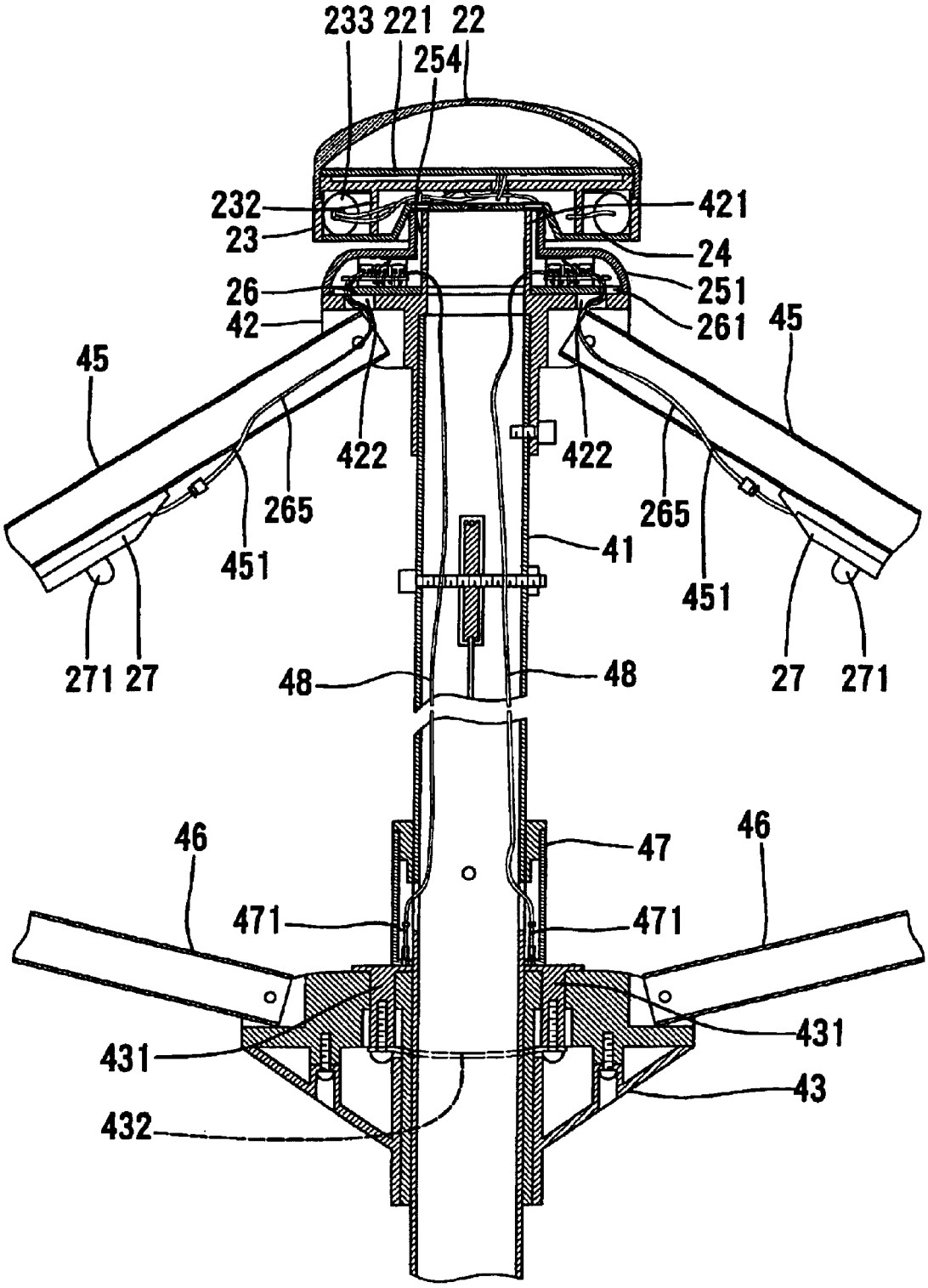
FIG. 14 is a sectional view similar to FIG. 13, illustrating operation of the sunshade.
Figure 15:
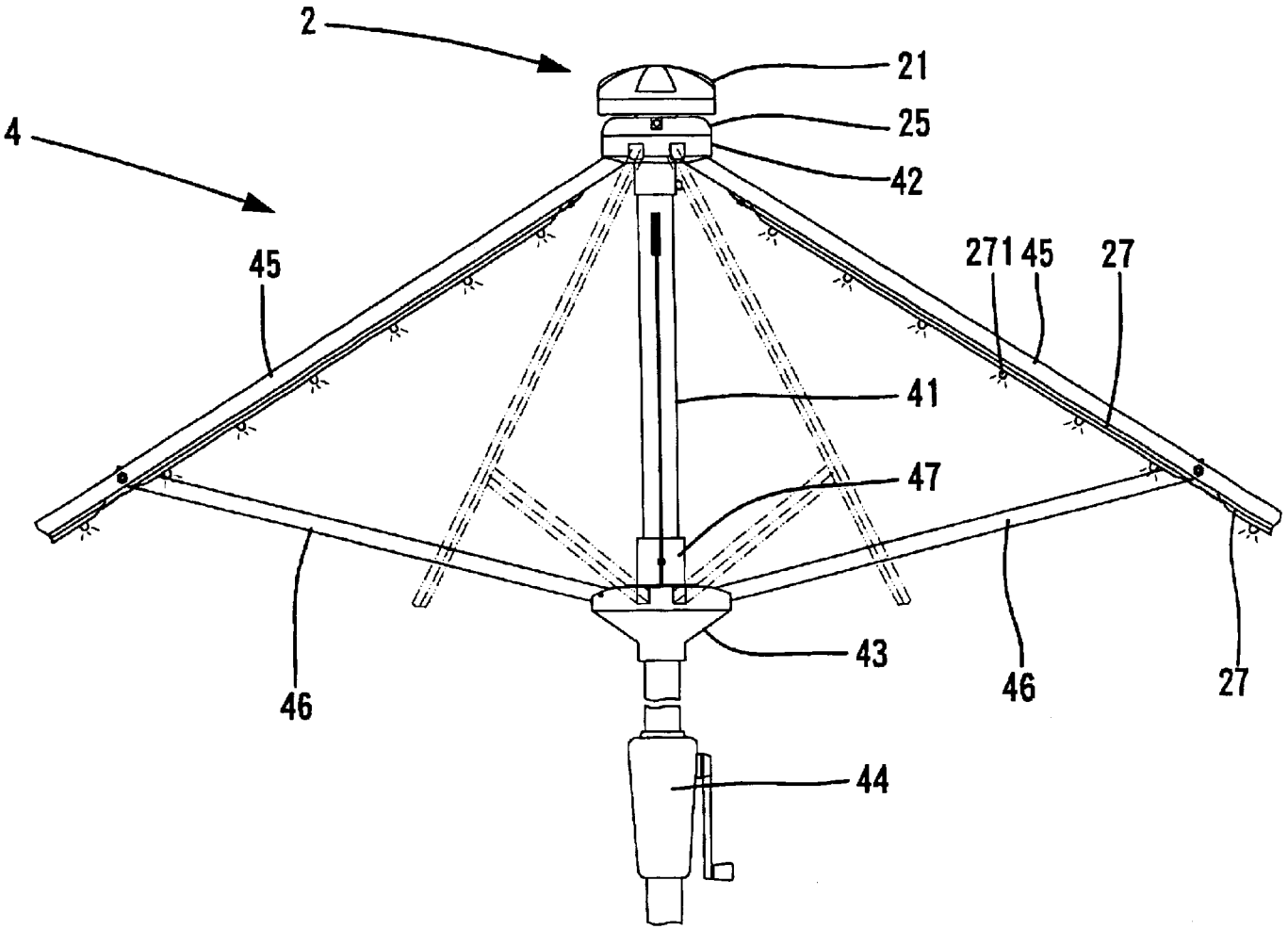
FIG. 15 is a schematic side view illustrating operation of the sunshade in FIG. 11.

Referring to FIGS. 12 through 14, the mounting member 25 is mounted on top of the rib-mounting member 42, with the tubular member 421 extending into the engaging hole 254 of the mounting member 25, with the respective screw 256 being turned inward to a position for frictionally retain the base 25 on the rib-mounting member 42. Wires 48 are connected between the respective conductive pin 471 and the respective circuit board 263, and wires 265 are connected between the respective female connector 264 and the respective circuit board 263. Wires 48 extend through a respective hole 423 of the tubular member 421 and through the post 41, with the wires 265 being extended through a respective hole 422 of the rib-mounting member 42 into the respective rib 45 and then out of the respective rib 45 via the hole 451 of the respective rib 45, with the respective female connector 264 being connected the male connector 273 of the respective uppermost light unit 27.

In use, when the reel 44 on the sunshade 4 is operated to unfold the sunshade 4, the runner 43 is moved upward to an unfolding position (i.e., the sunshade is opened) right below the positioning sleeve 47, with the conductive pegs 431 of the runner 43 being electrically connected to the conductive pins 471 of the positioning sleeve 47. Thus, a closed circuit is formed, and the bulbs 271 of the light units 27 are turned on.

The solar energy receiver 21 may be mounted on the sunshade at a place other than the mounting base 25. The solar energy receiver 21 may be mounted on the upper side of the sunshade 1, 3, 4 for receiving solar energy and transforming it into electricity that is then stored in the solar batteries 233. Furthermore, the mounting member 25 may be incorporated into the solar energy receiver 21 without departing from the scope of the invention.

Although the invention has been explained in relation to its preferred embodiment, it is to be understood that many other possible modifications and variations can be made without departing from the scope of the invention as hereinafter claimed.

What is claimed is:

1. A sunshade comprising:

a post having a rib-mounting member mounted thereon;

a plurality of ribs each having an upper end pivotally connected to the rib-mounting member;

a runner slidably mounted on the post;

a plurality of stretchers each having an upper end pivotally connected to an intermediate portion of an associated one of the ribs and a lower end pivotally connected to the runner;

a solar energy device mounted on the sunshade for receiving solar energy and transforming solar energy into electricity; and at least one light unit mounted on the sunshade, said at least one light unit being electrically connected to said solar energy device, wherein the solar energy device includes a solar energy receiver, and wherein the solar energy receiver includes a photoelectric plate and at least one solar battery electrically connected to the photoelectric plate.

2. The sunshade as claimed in claim 1, wherein the solar energy device includes a mounting base mounted on the rib-mounting member, with the solar energy receiver mounted on top of the mounting base.

3. The sunshade as claimed in claim 2, wherein said at least one light unit is mounted on at least one of the ribs.

4. The sunshade as claimed in claim 2, wherein the solar energy receiver includes a base securely engaged with the mounting base, a light-transmittable upper cover mounted above the base, and a lower cover below the base, the photoelectric plate being mounted between the base and the upper cover, said at least one solar battery being mounted in a compartment defined by the base and the lower cover.

5. The sunshade as claimed in claim 4, wherein the lower cover includes two contacts and a conductive member, the conductive member being electrically connected to one of the contacts, the solar energy receiver further having a conductive plate that is electrically connected to the other contact and to said at least one battery that is electrically connected to said one the contacts, the mounting base having two conductive plates that are electrically connected to the contacts.

6. The sunshade as claimed in claim 5, wherein the rib-mounting member includes a through-hole, the conductive member of the lower cover having a screw hole, further including a connecting member having an upper cover and a base mounted below the upper cover, a conductive post being provided on top of the upper cover, and two conductive plates being provided on the base with the conductive plates being electrically connected to the conductive column, an engaging member extending from the base into the through-hole of the rib-mounting member, with the conductive plates of the connecting member being electrically connected to the conductive plates of the mounting member, with the conductive column of the connecting member being threadedly engaged in the screw hole of the conductive member, and with an upper end of the conductive column pressing against the conductive plate of the solar energy receiver.

7. The sunshade as claimed in claim 2, wherein the rib-mounting member includes a tubular member, the mounting base having an engaging portion with an engaging hole for receiving the tubular member.

8. The sunshade as claimed in claim 1, wherein at least two light units are mounted on each said rib and electrically connected in series.

9. The sunshade as claimed in claim 1, wherein said at least one light unit has a switch for controlling on/off of said at least one light unit.

10. A sunshade comprising:

a post having a rib-mounting member mounted thereon;

a plurality of ribs each having an upper end pivotally connected to the rib-mounting member;

a runner slidably mounted on the post;

a plurality of stretchers each having an upper end pivotally connected to an intermediate portion of an associated one of the ribs and a lower end pivotally connected to the runner;

a solar energy device mounted on the sunshade for receiving solar energy and transforming solar energy into electricity; and at least one light unit mounted on the sunshade, said at least one light unit being electrically connected to said solar energy device;

wherein the solar energy device includes a mounting base mounted on the rib-mounting member and a solar energy receiver mounted on top of the mounting base;

wherein the rib-mounting member includes a tubular member, the mounting base having an engaging portion with an engaging hole for receiving the tubular member; and wherein the engaging portion includes two diametrically opposed engaging grooves, the solar energy receiver having two diametrically opposed engaging members that are engaged in the engaging grooves, the solar energy receiver being turned through an angle for securely mounting the solar energy receiver on the mounting base.

11. The sunshade as claimed in claim 10, wherein said at least one light unit has a switch for controlling on/off of said at least one light unit.

12. The sunshade as claimed in claim 10, wherein at least two light units are mounted on each said rib and electrically connected in series.

13. A sunshade comprising:

a post having a rib-mounting member mounted thereon;

a plurality of ribs each having an upper end pivotally connected to the rib-mounting member;

a runner slidably mounted on the post;

a plurality of stretchers each having an upper end pivotally connected to an intermediate portion of an associated one of the ribs and a lower end pivotally connected to the runner;

a solar energy device mounted on the sunshade for receiving solar energy and transforming solar energy into electricity; and at least two light units mounted on the sunshade, said at least two light units being electrically connected in series to said solar energy device; and wherein each of said at least two light units has a male connector on an end thereof and a female connector on another end thereof for releasable connection with the male connector on another said light unit.

14. The sunshade as claimed in claim 13, wherein said at least two light units have a switch for controlling on/off of said at least two light units.

15. The sunshade as claimed in claim 13, wherein said at least two light units are mounted on at least one of the ribs.

16. A sunshade comprising:

a post having a rib-mounting member mounted thereon;

a plurality of ribs each having an upper end pivotally connected to the rib-mounting member;

a runner slidably mounted on the post;

a plurality of stretchers each having an upper end pivotally connected to an intermediate portion of an associated one of the ribs and a lower end pivotally connected to the runner;

a solar energy device mounted on the sunshade for receiving solar energy and transforming solar energy into electricity; and at least one light unit mounted on the sunshade, said at least one light unit being electrically connected to said solar energy device;

wherein the solar energy device includes a mounting base and a solar energy receiver mounted on top of the mounting base, with the solar energy receiver including at least one solar battery; and wherein the mounting base includes at least one circuit board mounted therein and electrically connected to said at least one solar battery of the solar energy receiver, at least one connector being electrically connected to said at least one circuit board and extending out of the mounting base for connection with said at least one light unit.

17. The sunshade as claimed in claim 16, wherein the post includes a positioning sleeve mounted thereto, two conductive pins being mounted in the positioning sleeve, the conductive pins being electrically connected to said at least one circuit board, the runner including two conductive pegs mounted therein, wherein when the runner is moved to an unfolding position in which the sunshade is opened, the conductive pegs are electrically connected to the conductive pins to turn said at least one light unit on.

18. The sunshade as claimed in claim 16, wherein said at least one light unit has a switch for controlling on/off of said at least one light unit.

19. The sunshade as claimed in claim 16, wherein at least two light units are mounted on each said rib and electrically connected in series.

20. The sunshade as claimed in claim 16, wherein the mounting base is mounted on the rib-mounting member.

* * * * *